US007708078B2

(12) United States Patent
Stoesz

(10) Patent No.: US 7,708,078 B2
(45) Date of Patent: May 4, 2010

(54) APPARATUS AND METHOD FOR DELIVERING A CONDUCTOR DOWNHOLE

(75) Inventor: Carl W. Stoesz, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 146 days.

(21) Appl. No.: 11/732,914

(22) Filed: Apr. 5, 2007

(65) Prior Publication Data

US 2008/0245536 A1 Oct. 9, 2008

(51) Int. Cl.
*E21B 23/02* (2006.01)
*E21B 23/03* (2006.01)

(52) U.S. Cl. ..... 166/378; 166/376; 166/377; 166/380; 166/384

(58) Field of Classification Search ..... 166/384, 166/376, 377, 378, 380
See application file for complete search history.

(56) References Cited

U.S. PATENT DOCUMENTS

| | | | | |
|---|---|---|---|---|
| 4,685,516 | A | 8/1987 | Smith et al. | |
| 5,176,207 | A | 1/1993 | Keller | |
| 5,433,276 | A * | 7/1995 | Martain et al. | 166/384 |
| 5,435,395 | A | 7/1995 | Connell | |
| 5,526,888 | A * | 6/1996 | Gazewood | 175/320 |
| 5,957,206 | A | 9/1999 | Patel | |
| 6,065,540 | A | 5/2000 | Thomeer et al. | |
| 6,217,975 | B1 | 4/2001 | Daton-Lovett | |
| 6,257,339 | B1 * | 7/2001 | Haugen et al. | 166/387 |
| 6,766,853 | B2 | 7/2004 | Restarick et al. | |
| 6,955,218 | B2 | 10/2005 | Coon et al. | |
| 7,228,898 | B2 * | 6/2007 | Grigsby et al. | 166/242.6 |
| 2002/0162666 | A1 | 11/2002 | Koehler et al. | |
| 2004/0065444 | A1 | 4/2004 | Smith et al. | |
| 2005/0109518 | A1 | 5/2005 | Blacklaw | |
| 2005/0115741 | A1 | 6/2005 | Terry et al. | |
| 2006/0086508 | A1 | 4/2006 | Coon et al. | |

FOREIGN PATENT DOCUMENTS

| | | | |
|---|---|---|---|
| EP | 0417369 | A | 3/1991 |
| EP | 1033470 | A | 9/2000 |
| WO | 03/067018 | A2 | 8/2003 |
| WO | 2004/114487 | A1 | 12/2004 |
| WO | 2005/012689 | A1 | 2/2005 |
| WO | 2005/103437 | A1 | 11/2005 |
| WO | 2005/116388 | A1 | 12/2005 |
| WO | 2006/003208 | A1 | 1/2006 |

OTHER PUBLICATIONS

PCT Search Report and Written Opinion PCT/US2008/058402; Mailed Jul. 24, 2008; Search Report Having 6 Pages and Written Opinion Having 6 Pages.

Sas-Jaworsky, Alexander, et al.; "Development of Composite Coiled Tubing for Oilfiled Services"; SPE26536; 68th Annual Technical Conference and Exhibition of the SPE; Houston, TX; Oct. 3-6, 1993; 15 pages.

* cited by examiner

*Primary Examiner*—David J Bagnell
*Assistant Examiner*—Brad Harcourt
(74) *Attorney, Agent, or Firm*—Cantor Colburn LLP

(57) ABSTRACT

A conductor delivery arrangement includes a length of feedable tubing; a landing tool in operable communication with the feedable tubing; and a conductor in operable communication with the landing tool and method.

6 Claims, 2 Drawing Sheets

APPARATUS AND METHOD FOR DELIVERING A CONDUCTOR DOWNHOLE

BACKGROUND OF THE INVENTION

Modern wells, including hydrocarbon wells, utilize an ever-increasing amount of instrumentation. Such instrumentation is very helpful to the art in that it provides information about the downhole environment including parameters such as temperature, pressure, chemical constituency, strain and flow rate as well as many other parameters. Knowledge of such parameters allows a well operator to optimize efficiency of the well either through surface intervention, by pre-programmed downhole controllers or both. The result, of course, is greater production or higher quality production of target fluids. With all of the instrumentation in the downhole environment, conductors to convey the information to remote locations become very important. Such conductors may be electrical, hydraulic and even optical. While in many cases the conductor is attached to or made a part of a downhole tool before running, it is also not uncommon to deliver conductors to the downhole environment at sometime later than the time of installation of the tool. The "time later" may be a matter of minutes to a matter of years or decades depending upon the particular situation and the needs of the well operator.

For more stiff conductors such as electrical cable, running in the hole is accomplished in several known ways but for optic fiber, or other highly flexible and less durable conductors difficulty has been experienced by the art. Therefore, a relatively simple and cost effective means for delivering conductors including optic fibers to the downhole environment will be well received by the art.

SUMMARY

A conductor delivery arrangement includes a length of feedable tubing; a landing tool in operable communication with the feedable tubing; and a conductor in operable communication with the landing tool.

A method for delivery of a conductor to a tool in a wellbore includes installing a length of a conductor in a length of feedable tubing; running the feedable tubing and conductor therein into a wellbore; connecting the conductor to a preinstalled downhole connector; and pulling the feedable tubing while leaving the conductor in place.

BRIEF DESCRIPTION OF THE DRAWINGS

Referring now to the drawings wherein like elements are numbered alike in the several Figures.

DETAILED DESCRIPTION OF THE DRAWINGS

Figure 1:
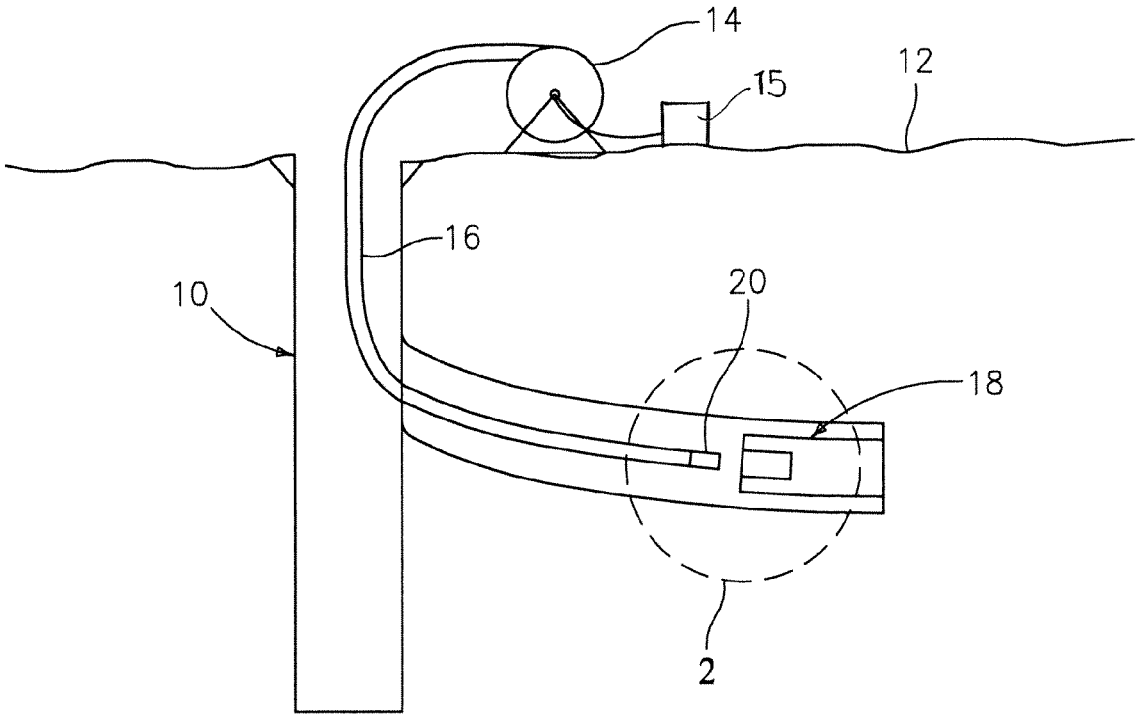
FIG. 1 is a schematic view of a well having a coil tubing unit disposed at surface and a connection site in the downhole environment.
Figure 2:
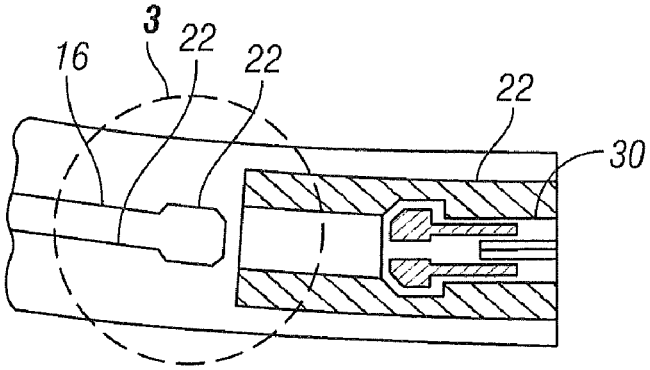
FIG. 2 is an enlarged view of the circumscribed area 2-2 in FIG. 1.
Figure 3:
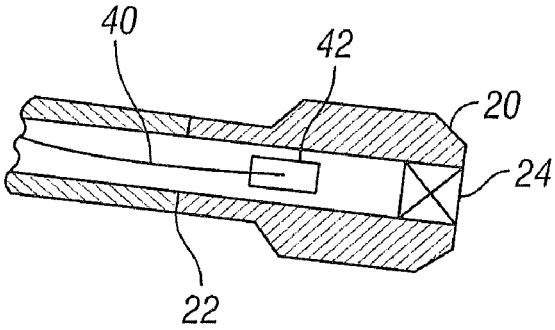
FIG. 3 is an enlarged view of the circumscribed area 3-3 in FIG. 2.
Figure 4:
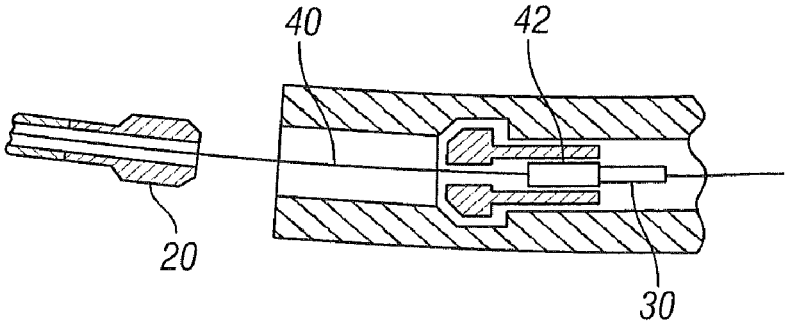
FIG. 4 is essentially the view of FIG. 2 but illustrated with the conductor received at the connector site.

Referring to FIG. 1, an overview of the concept hereof is provided, with FIGS. 2, 3 and 4 adding detail thereto. While the embodiment specifically shown and described considers an optic fiber delivery, it is to be appreciated that other conductors such as electrical conductors, etc. may also be placed in accordance with the teaching herein. Accordingly, limitation is not to be inferred by the ensuing discussion of fiber, which is merely one example of a particularly difficult conductor to place by other methods and apparatus.

In the FIG. 1 illustration, a wellbore 10 is shown extending from surface 12 into a subterranean environment. A feedable tubing unit 14 is positioned at the surface 12 and is illustrated in FIG. 1 having a length of feedable tubing (with a conductor 40 therein), just one example of which is coil tubing 16, extending into the wellbore 10 and into proximity with a preinstalled downhole tool connector 18.

Referring to FIG. 2, the circumscribed portion of FIG. 1 designated 2-2 is illustrated in enlarged form. In the FIG. 2 view, a landing tool 20 is visible. It is landing tool 20 that is either directly receivable in downhole tool connector 18, or otherwise operably attachable to downhole tool connector 18.

In one embodiment, two things occur at the downhole receiving tool 18, one is a mechanical connection of the landing tool 20 with the receiving tool 18 and the other is a signal connection. Mechanical connection may be effected in a number of ways such through a collet latch, engageable profile, etc. with the point being to positively locate and retain the landing tool 20 at the receiving tool 18. Many arrangements exist in the art for effecting this mechanical connection. Landing tool 20 is disposed at the end of the feedable tubing and may be configured to be retained in the receiving tool 18 and partable from coil tubing 16 at a parting line 22 or may be removed with the feedable tubing as it is withdrawn from the wellbore. IN the event that parting line 22 is included, indicating that the landing tool 20 is to be retained in the downhole environment, the parting line may represent an interference press fit connection or other defeatable connection between the landing tool 20 and the feedable tubing 16 upon a pull from uphole or a pressure buildup inside the feedable tubing, for example. The signal connection may also be effected by a number of commercially available arrangements and methods (identified below) for receiving the signal connection 42 disposed at landing tool 20, these being merely schematically illustrated at downhole tool connector 18 through the representation of an optical receiver 30 (or electrical connector, etc.). For signal connection, whether for transmission or monitoring, a means for effecting the connection while maintaining the connector in a clean condition to avoid loss of signal at the connection site is employed. Several such means are available from various sources. In addition, a debris barrier 28 such as that incorporated in a Hydraulic Wet Connect, which is commercially available from Baker Oil Tools, Houston Tex. may be included in some embodiments. Debris barrier 24 is illustrated schematically in FIG. 3. The downhole tool connector 18 includes an optical receiver 30 (or electrical connector, etc.).

In accordance with the teaching, hereof, the feedable tubing 16 is only temporarily installed in the wellbore for the purpose of conveying the conductor to the downhole tool. The length of feedable tubing 16 is then removed from the wellbore once the conductor 40 is secured to the downhole tool connector 18.

In operation, a length of conductor 40 which has previously been pumped or otherwise installed in a length of coil tubing 16 is run into the hole with the coil tubing 16. Before running, the conductor 40 is connected to landing tool 20 at parting line 22. In one embodiment the conductor (optical embodiment) includes an optical connection 42 (see FIG. 3), which may be a part of any of the exemplary connection means. It is to be understood that the connection components are illustrated simply to provide environment and enhance understanding since extensive disclosure here is not needed in view of the commercial availability of these connections. Landing tool 20 further may include the temporary debris barrier 24 as noted above to prevent wellbore fluids and/or solids from soiling the connection 42. The landing tool 20 is connected to the coil tubing 16 such that it is of a stable nature but configured to release from the coil tubing 16 through such as hydraulic pressure or overpull. Landing tool 20 then stays in contact with the downhole tool connector 18.

In order to facilitate removal of the coil tubing 16 from the wellbore 10 while ensuring that the conductor 40 stays in place and does not experience significant tensile stress, a fluid is pumped through the coil tubing, from a source pressurized fluid 15 in fluidic communication with the feedable tubing 16, contemporaneously with the withdrawal of the coil tubing 16 from the wellbore. As one of skill in the art will recognize, conductors, and particularly light conductors such as optic fibers, can be pumped through lengths of tubing by being carried along with the pumped fluid based upon frictional forces. This same principal is employed in the present invention but is used in reverse to leave the fiber in place while moving the tubing 16. The difference is that instead of causing the conductor to advance through a stationary tubing, the tubing is moved and the conductor remains stationary. The fluid pumped through the tubing allows for withdrawal of the tubing without the tensile stress on the conductor. Pumping and contemporaneous coil tubing removal is continued until the tubing 16 is completely removed from the wellbore. The conductor is then connected to surface equipment or any other desired connectivity.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A method for delivery of a conductor to a tool in a wellbore comprising:

installing a length of a conductor in a length of feedable tubing;

running the feedable tubing and conductor therein into a wellbore;

connecting the conductor to a preinstalled downhole connector; and pumping a fluid through the feedable tubing and simultaneously withdrawing the tubing from the wellbore while leaving the conductor in place.

2. The method for delivery of a conductor as claimed in claim 1 wherein the installing includes attaching the conductor to a landing tool.

3. The method for delivery of a conductor as claimed in claim 2 wherein the installing further comprises attaching the landing tool to the feedable tubing.

4. The method for delivery of a conductor as claimed in claim 3 wherein the method further includes separating the landing tool from the feedable tubing downhole subsequent to connecting the conductor to the preinstalled downhole tube connector.

5. The method for delivery of a conductor as claimed in claim 4 wherein the separating is by overpull.

6. The method for delivery of a conductor as claimed in claim 4 wherein the separating is by hydraulic pressure.

* * * * *